US011177068B2

(12) United States Patent
Atmanspacher et al.

(10) Patent No.: US 11,177,068 B2
(45) Date of Patent: Nov. 16, 2021

(54) ON-LOAD TAP CHANGER HEAD AND ON-LOAD TAP CHANGER HAVING AN ON-LOAD TAP CHANGER HEAD

(71) Applicant: MASCHINENFABRIK REINHAUSEN GMBH, Regensburg (DE)

(72) Inventors: Joerg Atmanspacher, Rinchnach (DE); Michael Goss, Deuerling (DE); Johannes Stempfhuber, Langquaid (DE); Klaus Schlepp, Maxhuette-Birkenhoehe (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 553 days.

(21) Appl. No.: 16/305,396

(22) PCT Filed: May 11, 2017

(86) PCT No.: PCT/EP2017/061302

§ 371 (c)(1),
(2) Date: Nov. 29, 2018

(87) PCT Pub. No.: WO2017/207237

PCT Pub. Date: Dec. 7, 2017

(65) Prior Publication Data

US 2021/0225583 A1 Jul. 22, 2021

(30) Foreign Application Priority Data

Jun. 2, 2016 (DE) ..... 10 2016 110 221.0

(51) Int. Cl.
*H01F 27/10* (2006.01)
*H01F 29/04* (2006.01)
(Continued)

(52) U.S. Cl.
CPC ..... *H01F 29/04* (2013.01); *H01F 21/12* (2013.01); *H01F 27/08* (2013.01); *H01F 27/10* (2013.01); *H01F 27/12* (2013.01); *H01F 29/02* (2013.01)

(58) Field of Classification Search
CPC ..... H01F 29/04; H01F 27/10; H01F 27/08; H01F 27/12; H01F 21/12; H01F 29/02
See application file for complete search history.

(56) References Cited

U.S. PATENT DOCUMENTS 8,351,169 B2 1/2013 Wakchaure
2011/0063064 A1 3/2011 Wolfgang et al.
2017/0352502 A1* 12/2017 Diao ..... H01F 7/0242

FOREIGN PATENT DOCUMENTS

CN 202034302 U 11/2011
CN 203071014 U 7/2013
(Continued)

*Primary Examiner* — Tuyen T Nguyen
(74) *Attorney, Agent, or Firm* — Leydig, Voit & Mayer, Ltd.

(57) ABSTRACT

An on-load tap changer head includes: a first region for an insulating fluid of the on-load tap changer to flow; a second region separated from the first region by a wall; and a detector for detecting an increased flow speed of the insulating fluid. The detector includes: a flow flap in the first region configured to tilt from a defined flow speed of the insulating fluid from a first position to a second position; a first magnet secured to the flap such that in the second position of the flow flap, the first magnet is in an immediate vicinity of the wall; a second magnet in the second region in the immediate vicinity of the wall; and a switch in the second region that is operationally coupled to the second magnet such that tilting over of the flow flap from the first position to the second position actuates the switch.

9 Claims, 6 Drawing Sheets

(51) Int. Cl.

| | |
|---|---|
| ***H01F 27/12*** | (2006.01) |
| ***H01F 21/12*** | (2006.01) |
| ***H01F 27/08*** | (2006.01) |
| *H01F 29/02* | (2006.01) |

(56) References Cited

FOREIGN PATENT DOCUMENTS

| | | | |
|---|---|---|---|
| DE | 1952048 | A1 | 6/1971 |
| DE | 2948111 | A1 | 6/1981 |
| DE | 3248275 | A1 | 9/1983 |
| EP | 2899728 | B1 | 11/2016 |
| GB | 741484 | A | 12/1955 |
| JP | S 61187313 | A | 8/1986 |
| JP | S 6472434 | A | 3/1989 |
| JP | H5118717 | A | 5/1993 |
| JP | 2001267149 | A | 9/2001 |
| JP | 2003214377 | A | 7/2003 |
| JP | 2011522428 | A | 7/2011 |
| JP | 2013251113 | A | 12/2013 |
| JP | 2015115397 | A | 6/2015 |

* cited by examiner

ON-LOAD TAP CHANGER HEAD AND ON-LOAD TAP CHANGER HAVING AN ON-LOAD TAP CHANGER HEAD

CROSS-REFERENCE TO PRIOR APPLICATIONS

This application is a U.S. National Stage Application under 35 U.S.C. § 371 of International Application No. PCT/EP2017/061302 filed on May 11, 2017, and claims benefit to German Patent Application No. DE 10 2016 110 221.0 filed on Jun. 2, 2016. The International Application was published in German on Dec. 7, 2017, as WO 2017/207237 A1 under PCT Article 21(2).

FIELD

The present invention relates to an on-load tap changer head and to an on-load tap changer with an on-load tap changer head.

BACKGROUND

For reasons of supply safety, high demands are placed on the on-load tap changer and the transformer in the case of use in electric energy systems. At the same time, transformers inclusive of on-load tap changers belong to the financially most costly plant components in this system. Protection of these plant components thus has highest priority and is prescribed in the body of standards. The load changeover switch oil tank is filled with a special insulating oil so as to cool and insulate the electrical conductors. In the case of a fault such as when, for example, there is a breakdown due to the insulating effect of the insulating medium being diminished by ageing or moisture, it is possible for a strong temperature increase to occur with partial degradation of the oil in the gas and an abrupt pressure rise connected therewith.

In that case, flow relays serve the purpose of detecting an insulating oil flow, which is triggered by a pressure rise as a consequence of a disturbance, from the interior of the on-load tap changer to the oil expansion vessel. A flow relay of that kind—also called protective relay—is known from, for example, DE 1 952 048 A. The protective relay includes a housing, which is arranged outside the transformer and which is connected on the one hand with a pipe duct coming out of the tap changer head and on the other hand with a duct leading to the oil expansion vessel. A barrier flap with a permanent magnet as well as a magnetically actuable reed switch are arranged in the interior of the housing. The lines of the reed switch are usually led through ceramic feeds out from the interior of the housing to above the housing. These lines are connected outside with a warning device. In the case of a sudden pressure rise in the on-load tap changer, the insulating oil flows out of the on-load tap changer through the housing of the flow relay into the oil expansion vessel. In that case, the barrier flap is turned over, the permanent magnet approaches the reed switch and actuates the contacts incorporated therein, and the reed switch triggers the signal in the warning device.

SUMMARY

An embodiment of the present invention incudes an on-load tap changer head for an on-load tap changer that includes: a first region, which is in the on-load tap changer head through which an insulating fluid of the on-load tap changer can flow; a second region separated from the first region by a wall; and a detector configured to detect an increased flow speed of the insulating fluid. The detector includes: a flow flap, which is arranged in the first region and is configured to tilt due to a defined flow speed of the insulating fluid from a first position to a second position; a first coupling magnet, which is secured to the flap such that in the second position of the flow flap, the first coupling magnet is disposed in an immediate vicinity of the wall; a second coupling magnet, which is in the second region in the immediate vicinity of the wall; and a switch, which is in the second region and which is operationally coupled to the second coupling magnet such that tilting over of the flow flap from the first position to the second position actuates the switch.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
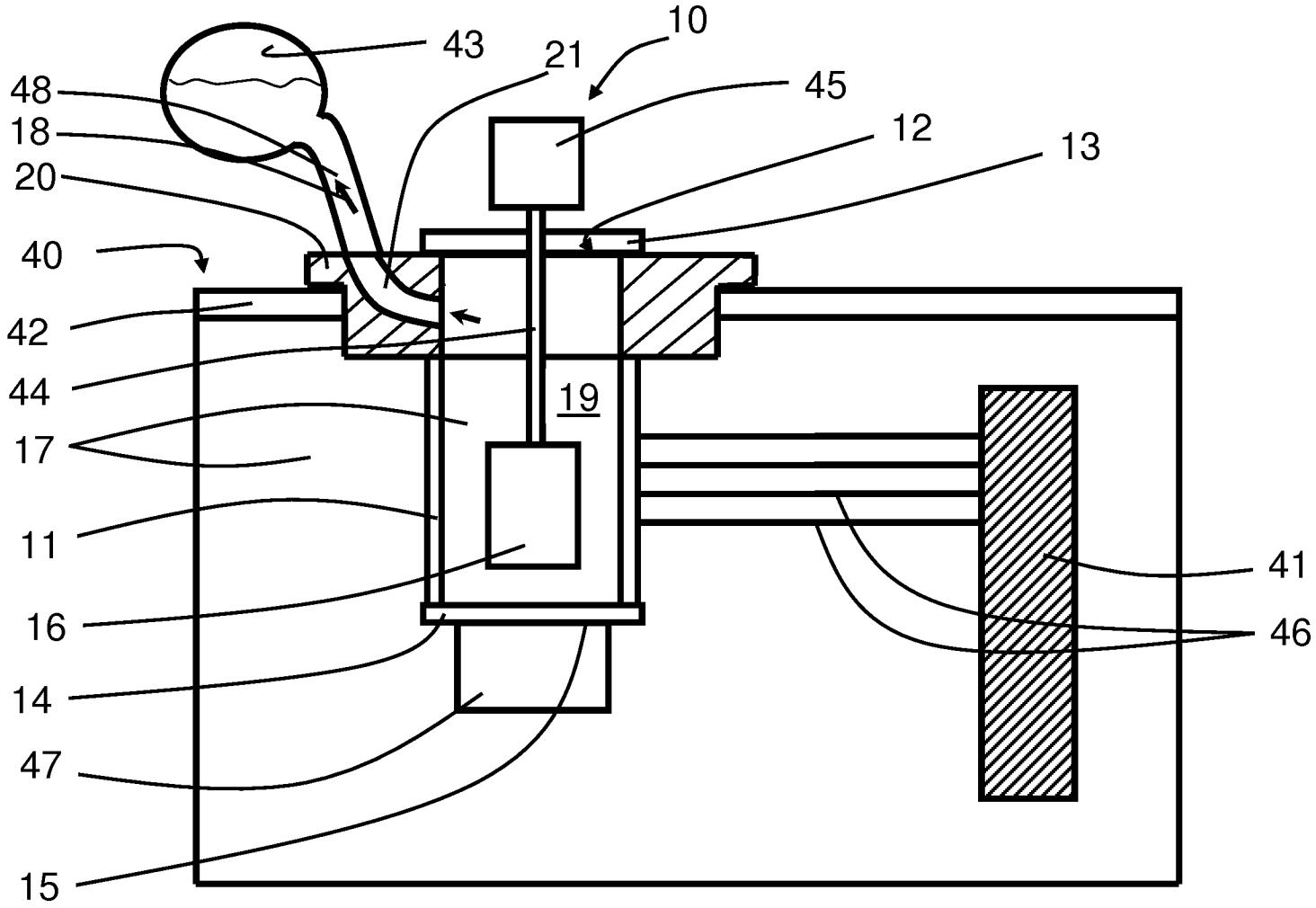
FIG. 1 shows a tapped transformer with an on-load tap changer having an on-load tap changer head in a first embodiment.

According to a first aspect, the invention provides an on-load tap changer head for or at an on-load tap changer, including:

- a first region which is formed in the on-load tap changer head and through which an insulating fluid of the on-load tap changer can flow;
- a second region separated from the first region by a wall; and
- a detector device for detection of increased flow speed of the insulating fluid, including:

a flow flap which is arranged in the first region and which from a defined flow speed of the insulating fluid tilts from a first position to a second position;

a first coupling magnet which is secured to the flap and in the second position of the flow flap is disposed in the immediate vicinity of the wall;

a second coupling magnet which is arranged in the second region in the immediate vicinity of the wall; and a switch which is arranged in the second region and so coupled to the second coupling magnet that the tilting over of the flow flap from the first position to the second position actuates the switch.

The invention makes it possible to neatly combine two components, namely an on-load tap changer head and a detector device, for example in the form of a flow relay. The construction of a tapped transformer is thus simplified, since the oil expansion vessel can be directly mounted on the on-load tap changer head. Through placing the flow flap in a separate region and the associated separation off of the switching chamber to a second region, the costs of the detector device are substantially reduced. Since the switches in the second region are no longer under oil, it is possible to rely on commercially available microswitches or similar. Costly bushing as well as switching elements that have to master the influences (corrosion, pressure, temperature) of the insulating oil are superfluous. The transmission of movements by means of the magnetic couplings is in that case particularly long-lasting and reliable.

The on-load tap changer head can be constructed in any desired mode and manner, preferably as a flange cast from metal.

The first region can be constructed in any desired mode and manner, preferably formed by casting or by milling in the on-load tap changer head.

The flow flap can be constructed in any desired mode and manner and preferably mechanically connected with the first coupling magnet directly or by way of a first shaft. The second coupling magnet in the second region can directly or indirectly actuate one or more switches. Moreover, every position of the flow flap in the first region can be detected by a switch in the second region by way of an appropriate arrangement of the coupling magnets.

The second region can be formed in any desired mode and manner and be defined in the on-load tap changer head or separately. The second region can in that case be formed over the first region outside the on-load tap changer, alongside and/or below the first region in the on-load tap changer and/or outside the on-load tap changer in the tapped transformer and consist of a separate housing.

The actuation of the switches can be devised in any desired mode and manner, for example by a rotatable second shaft with cams for the respective switches. In addition, the switches can be actuated by a preferably linearly or radially movable second coupling magnet directly or via a shaft. Depending on the respective construction, the switches in every position can be closed or actuated or can be open or non-actuated. Thus, for example, when the flow flap is tilted over a first coupling magnet can be removed from the immediate vicinity of the second coupling magnet and thus a switch opened and no longer actuated.

The switches can be constructed in any desired mode and manner, for example as microswitches, protective-gas magnetic switches, reed switches, flap switches, mercury tilt switches, proximity sensors or Hall sensors.

In an embodiment, the flow flap has a cut-out or an aperture. The size of the flow flap and of the aperture determines at which flow speed of the insulating fluid the flow flap tilts over.

In an embodiment, a resetting device is mechanically connected with the second coupling magnet by way of the second shaft and through actuation of the resetting device the first coupling magnet and thus the flow flap can be tilted over from a second position to a first position by the second coupling magnet.

In an embodiment, a resetting device is formed at the flow flap and through actuation of the resetting device the flow flap can be tilted over from a second position to a first position.

Depending on the respective form of an embodiment, the resetting device is arranged in the first or second region and serves for direct or indirect resetting of the flow flap from the first position to the second position.

According to a second aspect, the invention provides an on-load tap changer including:

a first on-load tap changer head constructed according to the first aspect;

a cylinder connected on a first side with the on-load tap changer head;

a cover connected with the on-load tap changer head;

a base connected with the cylinder on a second side opposite the first side;

a load changeover switch in the cylinder; and an insulating fluid in the cylinder.

The cylinder is preferably formed from a glass-fibre composite. A load changeover switch is arranged in the interior of the cylinder and preferably includes vacuum interrupters, switch-over resistances and mechanical contacts. The insulating fluid is preferably a mineral or a synthetic oil.

The explanations with respect to one of the aspects of the invention, particularly with respect to individual features of this aspect, correspondingly also apply in analogous manner to the other aspects.

Forms of embodiment of the invention are explained in more detail in the following by way of example with reference to the accompanying drawings. However, the individual features evident therefrom are not restricted to the individual forms of embodiment, but can be connected and/or combined with further above-described individual features and/or with individual features of other forms of embodiment. The details in the drawings are to be understood as merely explanatory, but not limitative. The reference numerals contained in the claims are not to limit the scope of protection of the invention in any way, but refer merely to the forms of embodiment shown in the drawings.

A tapped transformer 40 with a regulating winding and a main winding 41 is schematically depicted in FIG. 1. An on-load tap changer 10, which includes an on-load tap changer head 20 in a first embodiment, a cylinder 11, a cover 13 and a base 14, projects from above into the interior of the tapped transformer 40. The cylinder 11 preferably consists of a mixture of glass-fibre and plastics material, or of another insulating material. The on-load tap changer 10 is attached to the transformer cover 42 of the tapped transformer 40 by way of the on-load tap changer head 20. The on-load tap changer 10 is closed at its first, upper side 12 by the cover 13 and at its second lower side 15 by the base 14. A load changeover switch unit 16 is arranged in the interior 19 of the on-load tap changer 10. This can include, for example, mechanical switching contacts, vacuum interrupters, switch-over resistances, etc. An oil expansion vessel 43 is mounted on the tapped transformer 40 at the outside. The insulating fluid 17 present in the on-load tap changer 10 is hydraulically connected with the oil expansion vessel 43 via a first region 21 in the on-load tap changer head 20. The insulating fluid 17 is preferably a mineral oil or a synthetic oil. The tapped transformer 40 is also filled in the interior with the insulating fluid 17. For actuation of the load changeover switch unit 16 a drive shaft 44 driven, for example, by way of a motor 45 is led through the cover 13. The on-load tap changer 10 can be constructed either as a load changeover switch with a selector or as a load selector. Depending on the respective form of the on-load tap changer 10 a fine selector with or without a preselector 47 can be arranged below the base 14. The on-load tap changer 10 is connected with the regulating winding/main winding 41 by way of lines 46. The winding construction is here indicated only schematically. Depending on the respective mode of construction of the tapped transformer one or more windings are arranged on one or more cores. The windings are surrounded by the insulating fluid 17.

Figure 2:
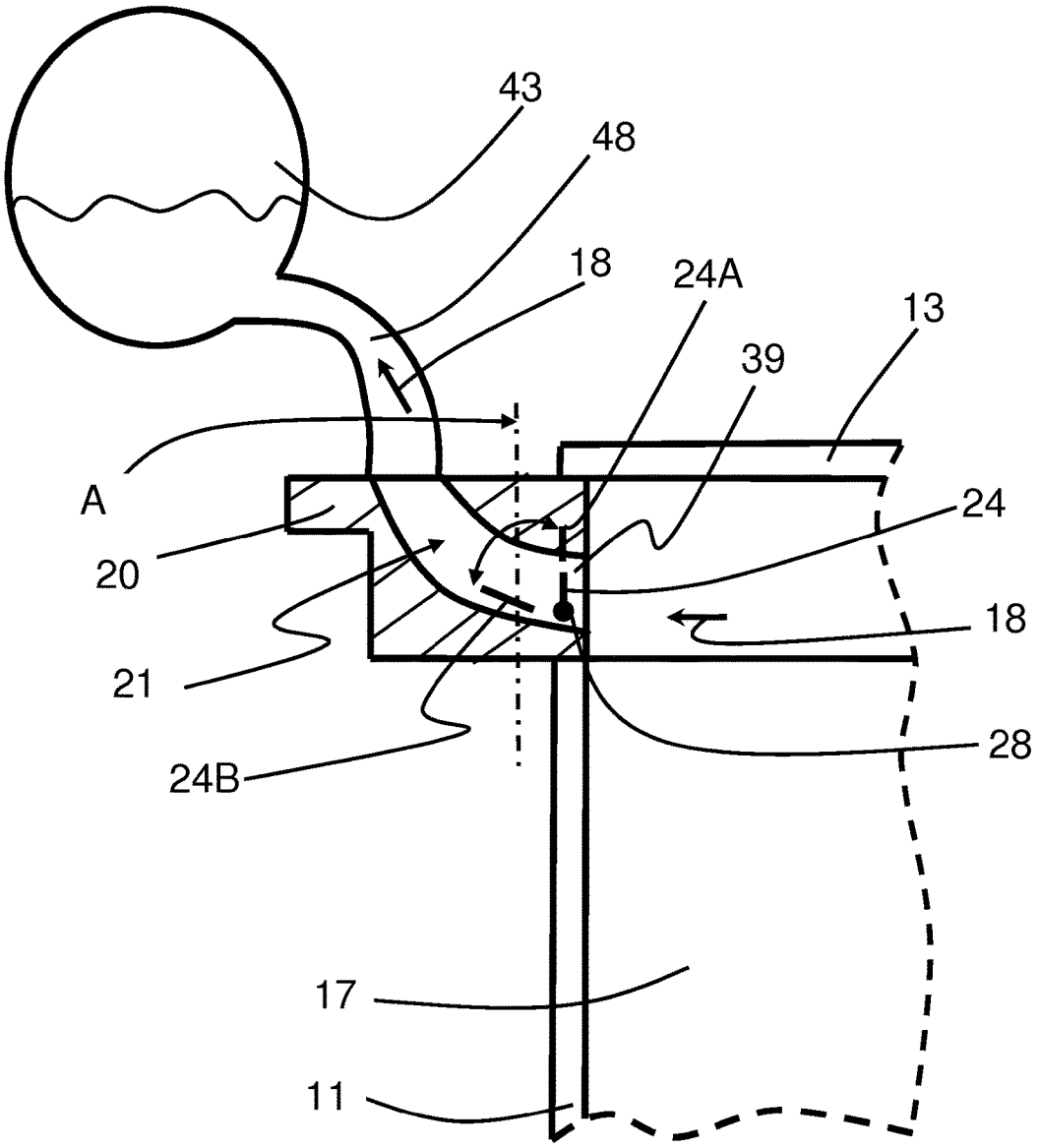
FIG. 2 shows a sectional view, to enlarged scale, of a part of the on-load tap changer head of FIG. 1.

The first region 21 of the on-load tap changer head 20 in the first embodiment together with a part of a detector device 39 is illustrated in section in FIG. 2. A flow flap 24 rotatably mounted on a shaft 28 is arranged in the first region 21. The flow flap 24 is disposed in a first position 24A. Through the mounting on the shaft 28 the flow flap 24 can be tilted over from the first position 24A into the second position 24B. The tilting over takes place as a consequence of a rapid pressure rise of the insulating fluid 17 in the interior 19 of the on-load tap changer 10. In that case the insulating fluid 17 flows out of the interior 19 (flow direction 18) of the on-load tap changer 10 through the first region 21 and a duct flange 48 to the oil expansion vessel 43.

Figure 3A:
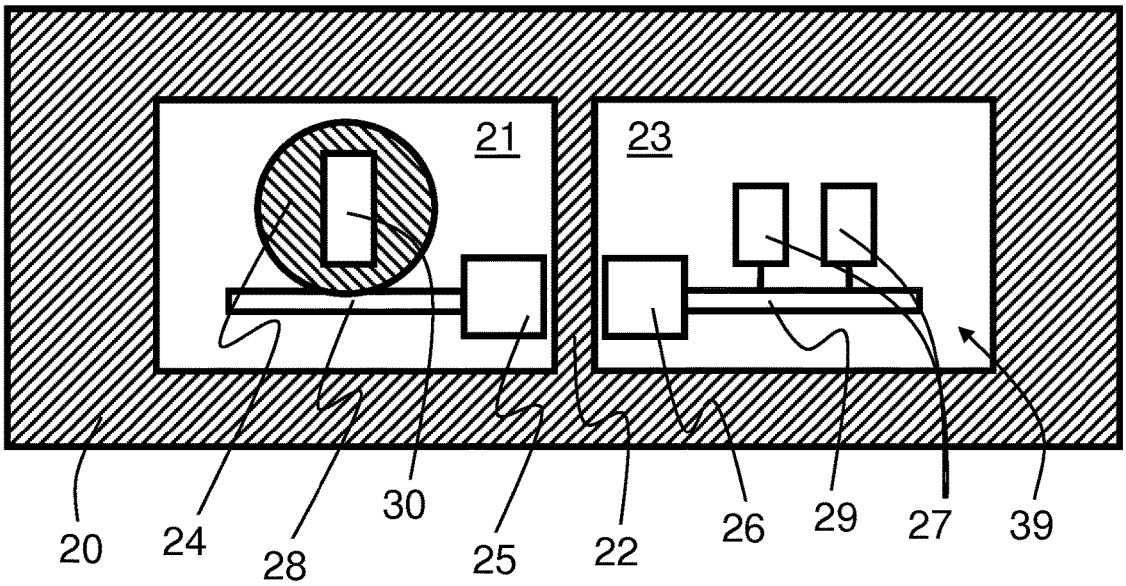
FIG. 3*a* shows a sectional view along the section line A of FIG. 2 of the on-load tap changer head of FIG. 1, which includes a first embodiment of a detector device.

A schematic detail view of the section A of FIG. 2 of the on-load tap changer head 20 in the first embodiment is shown in FIG. 3*a*, which includes a first embodiment of the detector device 39. The first region 21 (oil chamber) is separated off from a second region 23 (switch chamber) by a wall 22. In this embodiment of the on-load tap changer head 20 the two regions are formed in the on-load tap changer head 20. The flow flap 24 is mechanically connected by way of a first shaft 28 with a first coupling magnet 25 which is arranged in the immediate vicinity of the wall 22. The second coupling magnet 26 is arranged in the second region 23 in the immediate vicinity of the wall 22. The second coupling magnet 26 is connected by way of a second shaft 29 with two switches 27 via cams 33 illustrated in FIG. 4*a*. In this embodiment, the first shaft 28 and the first coupling magnet 25 are rotated when the flow flap 24 is tilted over from the first position 24A into the second position 24B. This rotational movement is magnetically transmitted through the wall 22 to the second coupling magnet 26 and the second shaft 29 so that the switches 27 are actuated. In this embodiment the switches 27 are actuated when the flow flap 24 has reached the second position 24B. The setting ranges between first and second positions can be monitored or simulated by any number of switches. The switches 27 can be constructed as microswitches, protective gas magnet switches, reed switches, flap switches, Hg tilt switches, proximity sensors or Hall sensors.

Figure 3B:
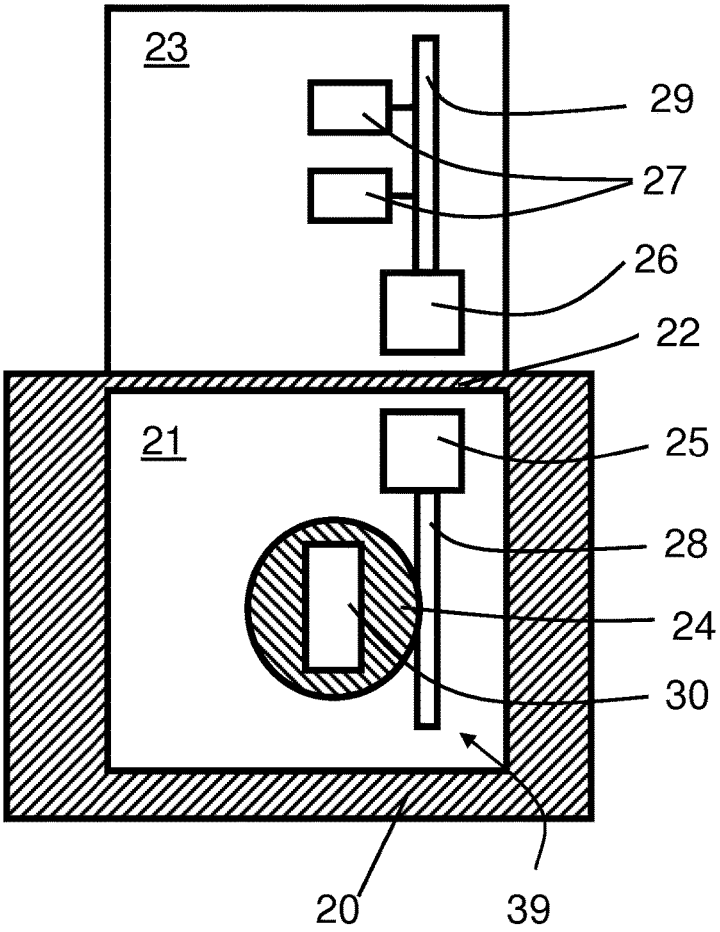
FIG. 3*b* shows a sectional view similar to FIG. 3*a* of a second embodiment of the on-load tap changer head, which includes the first embodiment of the detector device.

A schematic detail view of the on-load tap changer head 20 is shown in FIG. 3*b*, which is constructed in accordance with a second embodiment and includes the first embodiment of the detector device 39. The first region 21 is separated from a second region 23 by a wall 22. In this embodiment of the on-load tap changer head 20, the first region 21 is indeed formed in the on-load tap changer head 20, but the second region 23 is arranged outside the on-load tap changer head 20. In addition, by comparison with the first embodiment of the on-load tap changer head 20, the detector device 39 is turned upwardly through 90°. The second region 23 can be arranged outside in the vicinity of the cover 13 or also in the interior of the tapped transformer 40 and can include an individual housing. The flow flap 24 is mechanically connected by way of the shaft 28 with the first coupling magnet 25, which is arranged in the immediate vicinity of the wall 22. The second coupling magnet 26 is arranged in the second region 23 in the immediate vicinity of the wall 22. The second coupling magnet 26 is connected with one or more switches 27 by way of a second shaft 29. Here, too, the first shaft 28 and the first coupling magnet 25 are rotated when the flow flap 24 is tilted over from the first position 24A into the second position 24B. This rotational movement is magnetically transmitted through the wall 22 to the second coupling magnet 26 and the second shaft 29, so that the switches 27 are actuated by way of possible cams 33 illustrated in FIG. 4*a*. In this form of embodiment the switches 27 are actuated when the flow flap 24 has reached the second position 24B.

Figure 4A:
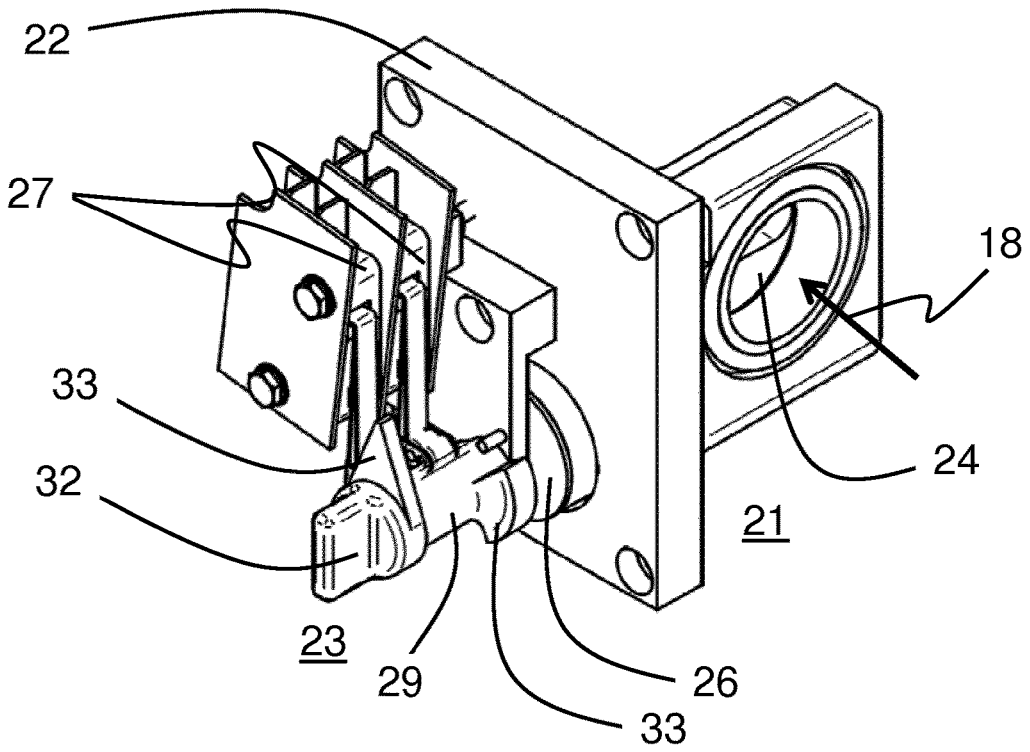
FIG. 4*a* shows a perspective view of a part of the first embodiment of the detector device, which is incorporated in the on-load tap changer head of FIG. 3*a;*
Figure 4B:
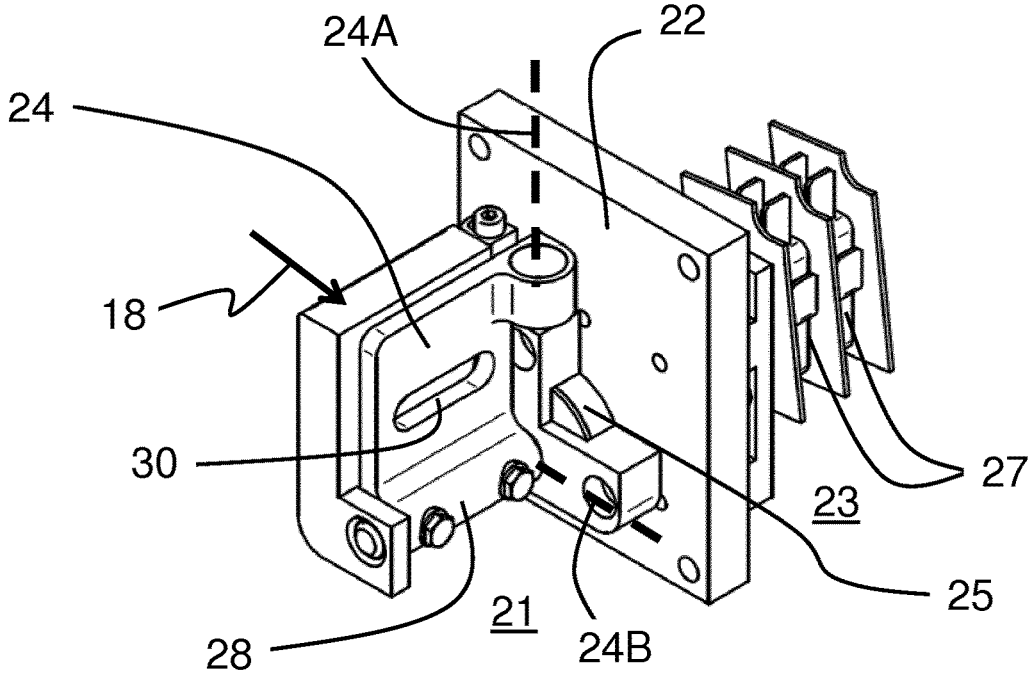
FIG. 4*b* shows a perspective view similar to FIG. 4*a* of the part of the detector device of FIG. 4*a*, which is incorporated in the on-load tap changer head of FIG. 3*b;*

A part of the first embodiment of the detector device 39 is shown in FIG. 4*a* and FIG. 4*b* in two views. The second shaft 29 co-operates with two switches 27. In that case, a plurality of cams 33 which actuate the switches 27 is formed on the second shaft 29. A resetting device 32 is formed at one end of the second shaft 29. Through actuation, i.e. rotation, thereof the flow flap is tilted from the second position 24B back to the first position 25A by way of the two coupling magnets 25, 26. The flow flap 24 is in that case tilted over by the insulating fluid 17 in a defined flow direction 18. By virtue of the size of the recess 30, also termed aperture, and the size of the flow flap the flow speed which is to be detected can be defined when the flow flap 24 is tilted over or triggered.

Figure 5A:
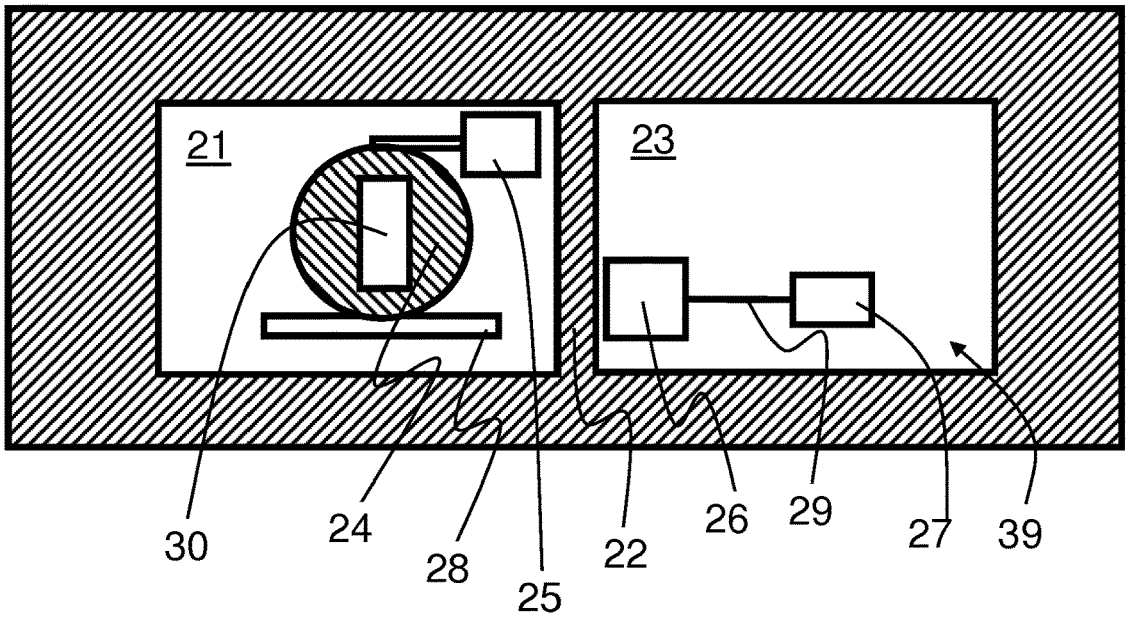
FIG. 5*a* shows a view, which is sectioned along the section line A of FIG. 2, of the on-load tap changer head of FIG. 1, which includes a second embodiment of the detector device.

A schematic detail view of the on-load tap changer head 20 is shown in FIG. 5*a*, which is constructed in accordance with a third embodiment and includes a second form of embodiment of the detector device 39. The first region 21 is separated from a second region 23 by a wall 22. In this embodiment of the on-load tap changer head 20, the two regions in the on-load tap changer head 20 are formed as in the case of the first embodiment. The flow flap 24 is mounted on a shaft 28. In this embodiment of the detector device 39, the first coupling magnet 25 is directly mechanically connected with the flow flap 24. The second coupling magnet 26 is arranged in the second region 23 in the immediate vicinity of the wall 22. The second coupling magnet 26 is here connected with a switch 27, for example, by way of a second shaft 29. In this embodiment, the first coupling magnet 25 is moved from a first position 24A to a second position 24B, which is in the immediate vicinity of the wall 22, when the flow flap 24 is tilted over. In the second position 24B, the first coupling magnet 25 acts via the wall 22 on the second coupling magnet 26, which executes a preferably linear movement and thus actuates the switch 27 directly or by way of the second shaft 29. The actuation of the switch takes place through pressing or drawing the second coupling magnet 26. In principle, it is also possible that in the first position the flow flap 24 actuates the switch 27 in the second region 23 and on tilting over into the second position 24B there is no longer any actuation of the switch 27.

Figure 5B:
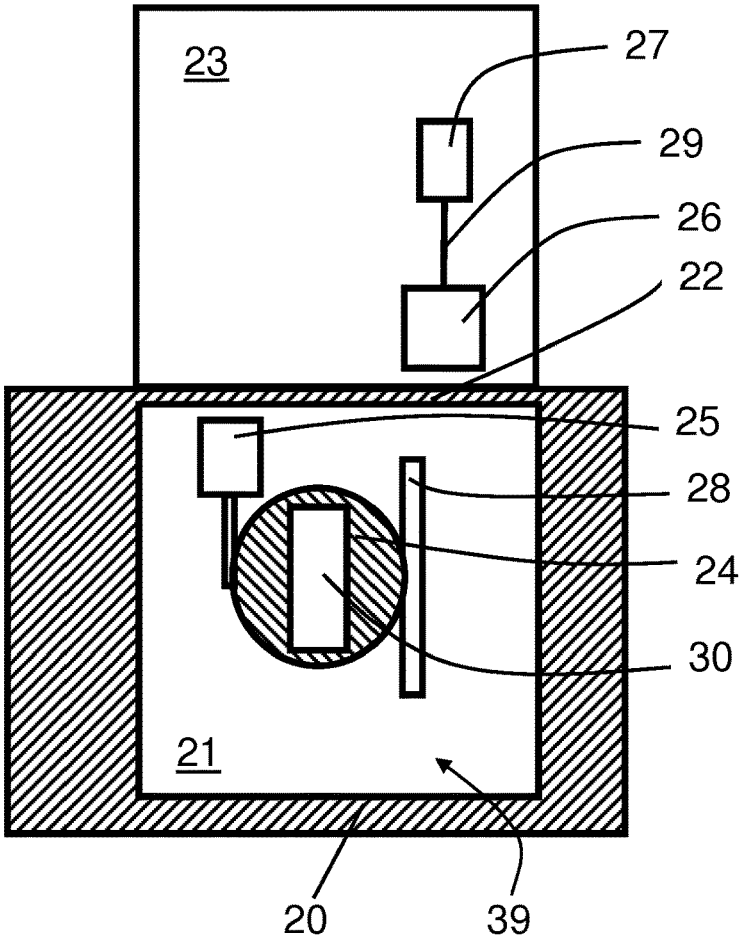
FIG. 5*b* shows a sectional view similar to FIG. 5*a* of a third embodiment of the on-load tap changer head.

A schematic detail view of the on-load tap changer head 20 is shown in FIG. 5*b*, which is constructed in accordance with a fourth embodiment and includes the second embodiment of the detector device 39. The first region 21 is separated from a second region 23 by a wall 22. In this embodiment of the on-load tap changer head 20, the first region 21 in the on-load tap changer head 20 is indeed constructed like the second embodiment, but the second region 23 is arranged outside the on-load tap changer head 20. In addition, by comparison with the third embodiment of the on-load tap changer head 20, the detector device 39 is turned upwardly through 90°. The second region 23 can be arranged outside in the vicinity of the cover 13 or also in the interior of the tapped transformer 40. The flow flap 24 is mechanically connected by way of the shaft 28 with a first coupling magnet 25, which is arranged in the immediate vicinity of the wall 22. The second coupling magnet 26 is arranged in the second region 23 analogously in the immediate vicinity of the wall 22. Here, for example, the coupling magnet 26 is also connected with a switch 27 by way of a second shaft 29. The first coupling magnet 25 is here also moved from a first position 24A into a second position 24B, which is in the immediate vicinity of the wall 22, when the flow flap 24 is tilted over. In the second position 24B, the first coupling magnet 25 acts through the wall 22 on the second coupling magnet 26, which executes a preferably linear movement and thus actuates the switch 27 directly or by way of the second shaft 29. The actuation of the switch takes place through pressing or drawing the second coupling magnet 26. In principle it is also possible that in the first position the flow flap 24 actuates the switch 27 in the second region 23 and when tilted over into the second position 24B there is no longer any actuation of the switch 27.

Figure 6A:
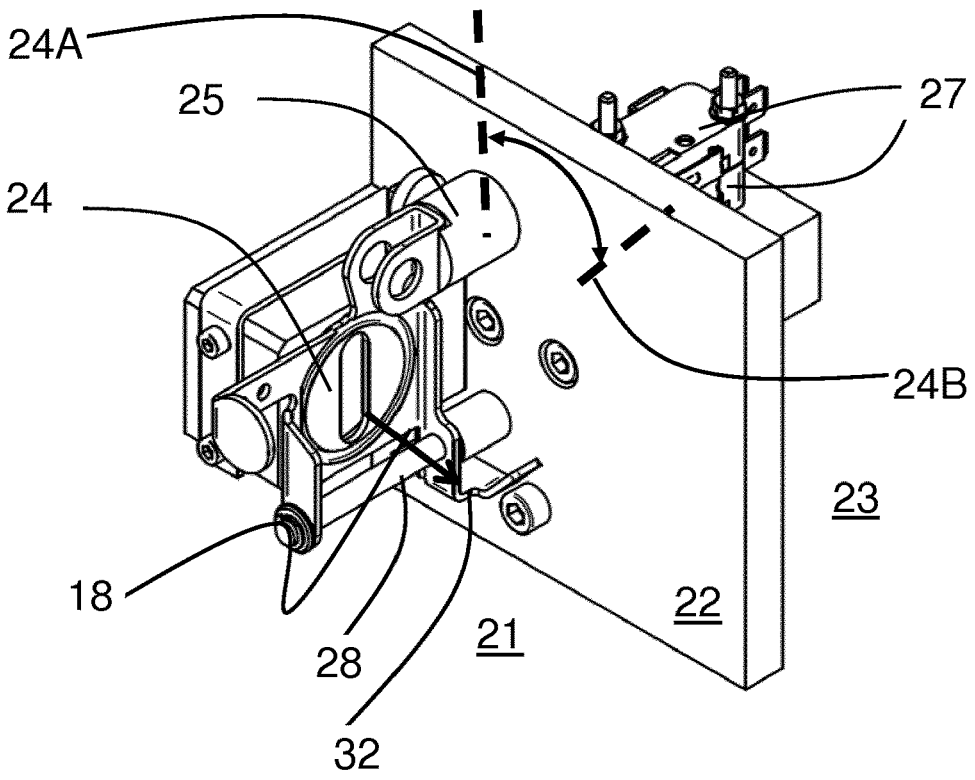
FIG. 6*a* shows a perspective view of a part of the embodiment of the detector device, which is incorporated in the on-load tap changer head of FIG. 5*a*.
Figure 6B:
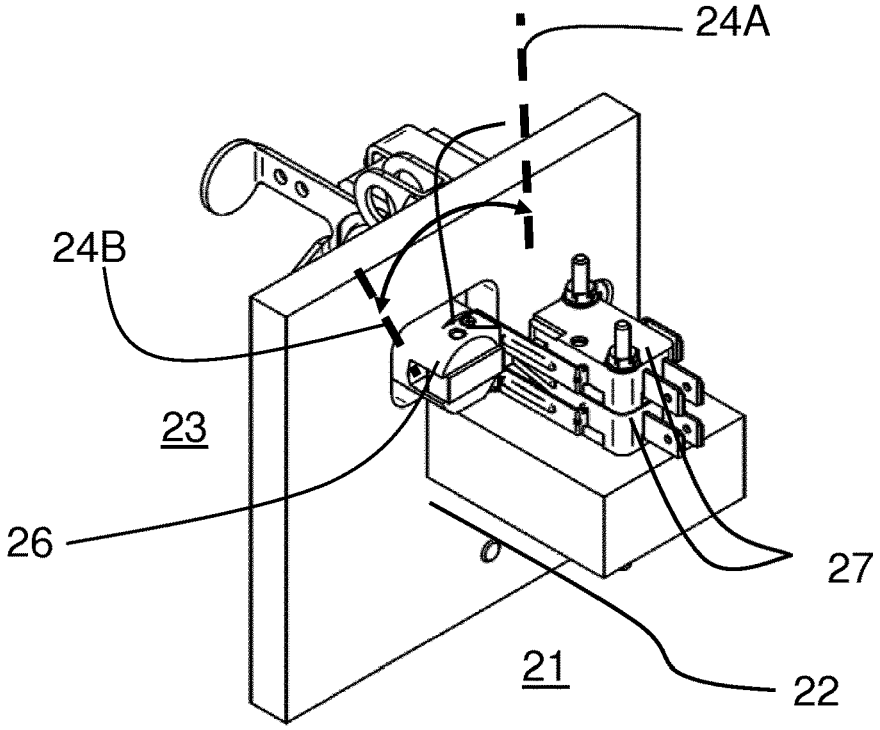
FIG. 6*b* shows a perspective view similar to FIG. 6*a* of the part of the detector device of FIG. 6*a*, which is incorporated in the on-load tap changer head of FIG. 5*b*.

A part of the second embodiment of the detector device 39 is shown in FIG. 6*a* and FIG. 6*b* in two views. A first coupling magnet 25 is arranged at the flow flap 24, which is rotatably mounted on the first shaft 28. When the flow flap 24 is tilted over by the flow of the insulating fluid 17 in a flow direction 18 the first coupling magnet 25 is brought from the first position 24A into the second position 24B. In the second position 24B the first coupling magnet 25 acts via the wall on the second coupling magnet 26 in the second region 23 and actuates the switches 27.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The following is a list of reference numerals used herein:

10 on-load tap changer
11 cylinder
12 first side of 10
13 cover
14 base
15 second side of 10
16 load changeover switch
17 insulating fluid
18 flow direction
19 interior of 10
20 on-load tap changer head
21 first region (oil chamber)
22 wall
23 second region (switch chamber)
24 flow flap
25 first coupling magnet
26 second coupling magnet
27 switch
28 first shaft
29 second shaft
30 recess, aperture
31 pin
32 resetting device
33 cam
39 detector device
40 tapped transformer
41 main winding/regulating winding
42 transformer cover
43 oil expansion vessel
44 drive shaft
45 motor
46 lines
47 fine selector/preselector
48 duct flange

The invention claimed is:

1. An on-load tap changer head for an on-load tap changer, the on-load tap changer head comprising:

a first region, which is in the on-load tap changer head through which an insulating fluid of the on-load tap changer can flow;

a second region separated from the first region by a wall; and a detector configured to detect an increased flow speed of the insulating fluid, the detector comprising:

a flow flap, which is arranged in the first region and is configured to tilt due to a defined flow speed of the insulating fluid from a first position to a second position;

a first coupling magnet, which is secured to the flap such that in the second position of the flow flap, the first coupling magnet is disposed in an immediate vicinity of the wall;

a second coupling magnet, which is in the second region in the immediate vicinity of the wall; and a switch, which is in the second region and which is operationally coupled to the second coupling magnet such that tilting over of the flow flap from the first position to the second position actuates the switch.

2. The on-load tap changer head according to claim 1, wherein the second region is in the on-load tap changer head or outside the on-load tap changer head.

3. The on-load tap changer head according to claim 1, wherein:

the first coupling magnet is connected with the flow flap by a first shaft;

the second coupling magnet is connected with the switch by a second shaft; and through tilting over of the flow flap from the first position to the second position, the switch is configured to be actuated by rotation of the first shaft and the second shaft and of the first coupling magnet and the second coupling magnet.

4. The on-load tap changer head according to claim 3, wherein:

a resetting device is mechanically connected with the second coupling magnet by the second shaft; and through actuation of the resetting device, the first coupling magnet and the flow flap are tiltable over from a second position to a first position by the second coupling magnet.

5. The on-load tap changer head according to claim 1, wherein:

the first coupling magnet is directly connected with the flow flap;

the second coupling magnet is connected with the switch; and through tilting over the flow flap from the first position to the second position, the first coupling magnet is configured to be brought into the immediate vicinity of the second coupling magnet such that the switch is actuated by the second coupling magnet.

6. The on-load tap changer head according to claim 1, wherein the switch is a microswitch.

7. The on-load tap changer head according to claim 1, wherein the flow flap has a cut-out.

8. The on-load tap changer head according to claim 1, wherein:

a resetting device is at the flow flap; and through actuation of the resetting device, the flow flap is tiltable over from the second position to the first position.

9. An on-load tap changer comprising:

the on-load tap changer head according to claim 1;

a cylinder connected on a first side with the on-load tap changer head;

a cover connected with the on-load tap changer head;

a base connected with the cylinder on a second side opposite the first side;

a load changeover switch in the cylinder; and an insulating fluid in the cylinder.

* * * * *